US006059051A

United States Patent [19]

Jewkes et al.

[11] Patent Number: 6,059,051

[45] Date of Patent: May 9, 2000

[54] INTEGRATED DIRECTIONAL UNDER-REAMER AND STABILIZER

[75] Inventors: Donald Jewkes, New Orleans, La.; Volker Krueger, Cell, Germany

[73] Assignee: Baker Hughes Incorporated, Houston, Tex.

[21] Appl. No.: 08/962,491

[22] Filed: Oct. 31, 1997

Related U.S. Application Data

[60] Provisional application No. 60/030,127, Nov. 4, 1996.

[51] Int. Cl.[7] ..... E21B 7/04; E21B 4/02; E21B 10/32

[52] U.S. Cl. ..... 175/76; 175/269; 175/325.3; 175/385; 175/406

[58] Field of Search ..... 175/57, 61, 267, 175/269, 76, 325.3, 406, 385

[56] References Cited

U.S. PATENT DOCUMENTS

| | | | |
|---|---|---|---|
| 3,104,134 | 9/1963 | Nielsen et al. | 175/325.3 |
| 3,851,719 | 12/1974 | Thompson et al. | 175/406 |
| 4,040,495 | 8/1977 | Kellner et al. | 175/73 |
| 4,133,396 | 1/1979 | Tschirky | 175/57 |
| 4,385,669 | 5/1983 | Knutsen | 175/57 |
| 4,646,856 | 3/1987 | Dismukes | 175/107 |
| 4,660,657 | 4/1987 | Furse et al. | 175/269 |
| 4,709,462 | 12/1987 | Perkin et al. | 29/434 |
| 4,775,017 | 10/1988 | Forrest et al. | 175/65 |
| 4,862,974 | 9/1989 | Warren et al. | 175/61 |
| 5,060,736 | 10/1991 | Neff | 175/74 |
| 5,184,687 | 2/1993 | Abdrakhmanow et al. | 175/267 |
| 5,311,953 | 5/1994 | Walker | 175/61 |
| 5,402,856 | 4/1995 | Warren et al. | 175/57 |
| 5,474,143 | 12/1995 | Majikovic | 175/323 |
| 5,765,653 | 6/1998 | Doster et al. | 175/75 |

FOREIGN PATENT DOCUMENTS

WO 94/09244 4/1994 WIPO .

*Primary Examiner*—Hoang Dang
*Attorney, Agent, or Firm*—Madan, Mossman & Sriram, P.C.

[57] ABSTRACT

The present invention is an apparatus for use in drilling operations. It uses an under-reamer having a plurality of elongated arms with cutting elements at the ends of the arms for enlarging a previously drilled borehole drilled by a drill bit. One or more stabilizers in close proximity to the under-reamer provide stability to the under-reamer and the drill bit. The stabilizer could be rotating or non-rotating; and could be positioned between the under-reamer and the drill bit, or above the under reamer or above a directional device on the drillstring. The cutting arms are selectively operable to perform the enlargement. The stabilizer may be provided with members that closely fit the size of the borehole.

9 Claims, 6 Drawing Sheets

INTEGRATED DIRECTIONAL UNDER-REAMER AND STABILIZER

CROSS REFERENCE TO RELATED APPLICATIONS

This application is based upon and claims priority from U.S. Provisional Application Ser. No. 60/030,127 filed on Nov. 4, 1996.

FIELD OF THE INVENTION

This invention relates generally to wellbore construction and more particularly to directional drilling and opening of large-diameter boreholes using an integrated, directional under-reamer and non-rotating stabilizer.

BACKGROUND OF THE ART

To obtain hydrocarbons such as oil and gas, wellbores or boreholes are drilled from one or more surface locations into hydrocarbon-bearing subterranean geological strata or formations (also referred to in the industry as the reservoirs). A large proportion of the current drilling activity involves drilling highly deviated and/or substantially horizontal wellbores extending through the reservoir.

To develop an oil and gas field, especially an offshore field, multiple wellbores are drilled from an offshore rig or platform stationed at a fixed location. A template is placed on the earth's surface that defines the location and size of each wellbore to be drilled. The various wellbores are then drilled along their respective predetermined paths.

Whether for onshore drilling or offshore drilling of multiple wellbores from a common location, each wellbore is drilled to a predetermined depth in the earth's surface. Frequently, ten to twenty offshore wellbores are drilled from an offshore rig stationed at a single location. Each such wellbore is drilled to a respective predetermined vertical depth and then deviated to reach a desired subterranean formation.

The above-described wellbore construction requires drilling a top or surface portion of the wellbore, with a large diameter to accommodate the casing, and then drilling the production or pilot wellbore, which is relatively smaller in diameter. There are many other situations in the well-drilling business where it is required to drill a hole a size larger than the prior hole drift. Many tools have been developed over the past thirty years to drill the oversized hole sections. These tools include conventional under-reamers, bi-center bit and ream-while-drilling tools. Until most recently these tools have not been used extensively in directional, drilling-while-reaming applications primarily due to torque requirements of the downhole motor.

If the wellbore is vertical, few problems exist in running the two drilling operations (drilling the pilot hole and opening the hole to a larger diameter) at the same time. A pilot bit drills the pilot hole and an apparatus such as an under-reamer, which is positioned uphole from the pilot bit, follows along the same line as the pilot bit and opens the pilot hole to the desired diameter to accommodate the casing. New drilling methods, however, frequently require that the wellbore be deviated—drilled at an angle to the vertical axis. This deviation causes problems for the under-reamer since it no longer follows vertically into the wellbore after the drill bit. Using current apparatus, the under-reamer is now operating along an axis that does not correspond to the axis of the pilot bit.

An important aspect of drilling a deviated or horizontal wellbore is to drill it along a predetermined wellpath. During drilling of the wellbore, it is important to accurately determine the true location of the pilot bit relative to a reference point so as to continuously maintain the pilot bit along the desired wellpath. The current drill strings usually include a large number of sensors to provide information about the pilot bit location, formation parameters, borehole parameters and the tool condition and a relatively low data transmission telemetry, such as the mud-pulse telemetry. In such systems, the pilot bit location data is transmitted to the surface periodically and used to send directional instructions to keep the pilot bit on course.

The next problem to solve is to provide consistent directional control and stability for the under-reamer operations. Commonly used rotating stabilizers are satisfactory for pilot hole drilling and for vertical drilling of a pilot hole with simultaneous under-reamer drilling to open the hole. They may not be effective, however, in providing the required stability when the under-reamer is operated simultaneously with a pilot bit in drilling deviated wellbores. It is important to provide a point of stability close to the under-reamer to prevent wobbling of the under-reamer while it is drilling a larger borehole behind the pilot hole. Additionally, the current under-reamer operations make the downhole motor operate less efficiently due to additional stress caused by the under-reamer drilling along an axis that is not in line with the axis of the pilot bit.

The present invention addresses the above-described problems with the prior art methods for drilling. It uses an under-reamer/bi-center bit or ream-while -drilling tool run below a bent housing motor. In one embodiment of the invention, a non-rotating stabilizer blade is placed between the reamer arms and the pilot bit. The non-rotating stabilizer is an integral part of the reamer body to minimize the distance between the stabilizer blades and the reamer arms. The distance between the reamer arms and the stabilizer blades minimizes side loads on the reamer arms. Because the stabilizer is non-rotational, the torque output of the bent housing motor is reduced which is an important factor in drilling larger hole sizes. However, a non-rotating stabilizer is more complex and less rugged than a rotating stabilizer.

In an alternate embodiment of the invention, the stabilizer is located between the under-reamer and the drill bit but is fixed with respect to the drill bit. In such an arrangement, provision is made in the stabilizer for passages to allow return flow of drilling mud to the surface. In yet another embodiment of the invention, a stabilizer that adjustably engages the borehole is located above under-reamer.

SUMMARY OF THE INVENTION

The present invention is an under-reamer assembly having a stabilizer integrated with an under-reamer and positioned within the assembly to minimize the distance between the stabilizer and the under-reamer. The under-reamer has a plurality of elongated arms, each arm pivotally attached at one end to the body of the under-reamer and having a cutting element at the other end. The arms are selectively operable between a deactivated rest position and an activated cutting position.

Examples of the more important features of the invention have been summarized rather broadly so that the detailed description that follows may be better understood, and so that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the embodiments, taken in conjunction with the accompanying drawings, in which like elements have been given like numerals, wherein.

DETAILED DESCRIPTION OF THE EMBODIMENTS

Figure 1:
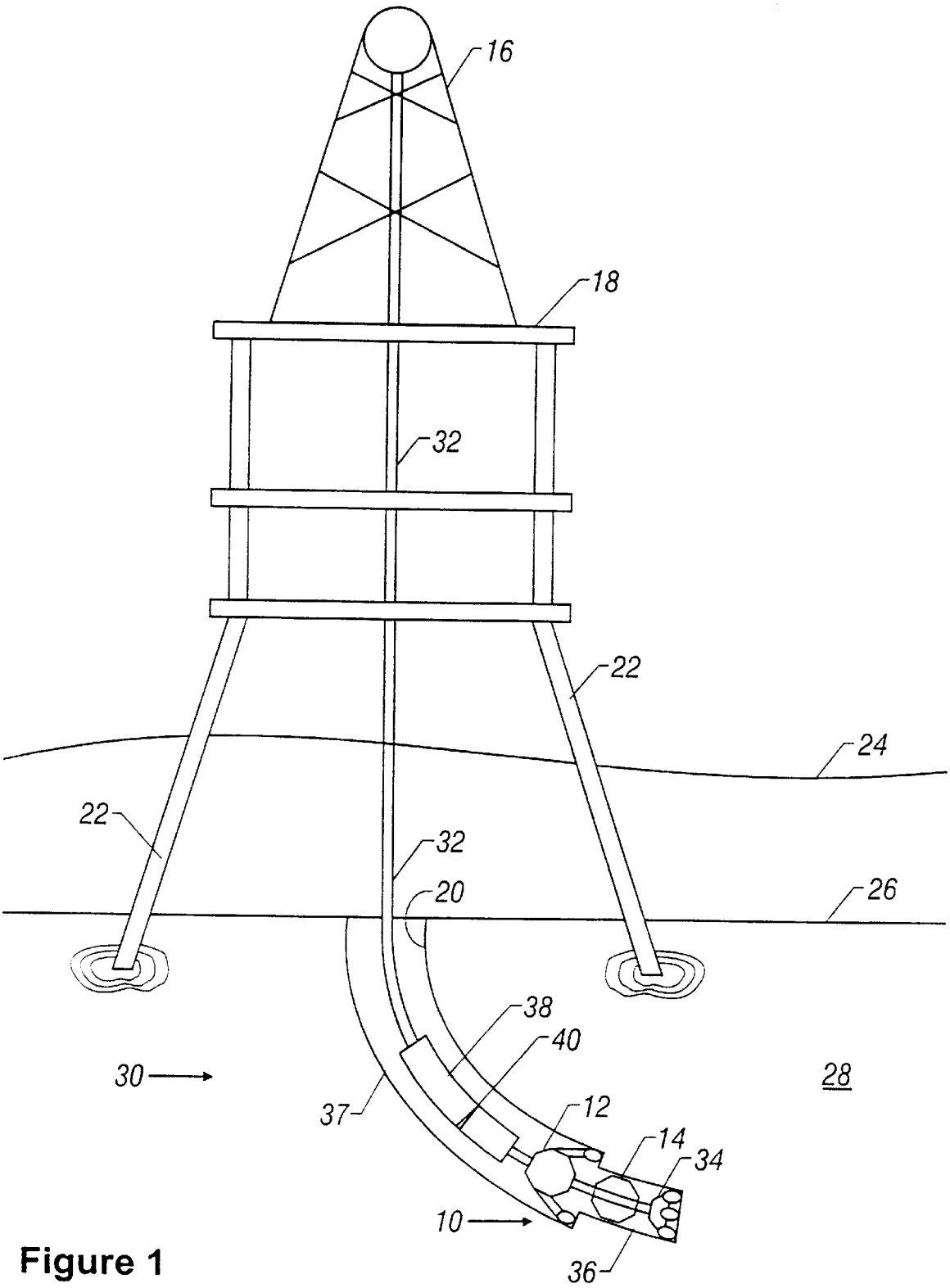
FIG. 1 illustrates an offshore drilling operation using an under-reamer assembly of the present invention.
Figure 2:
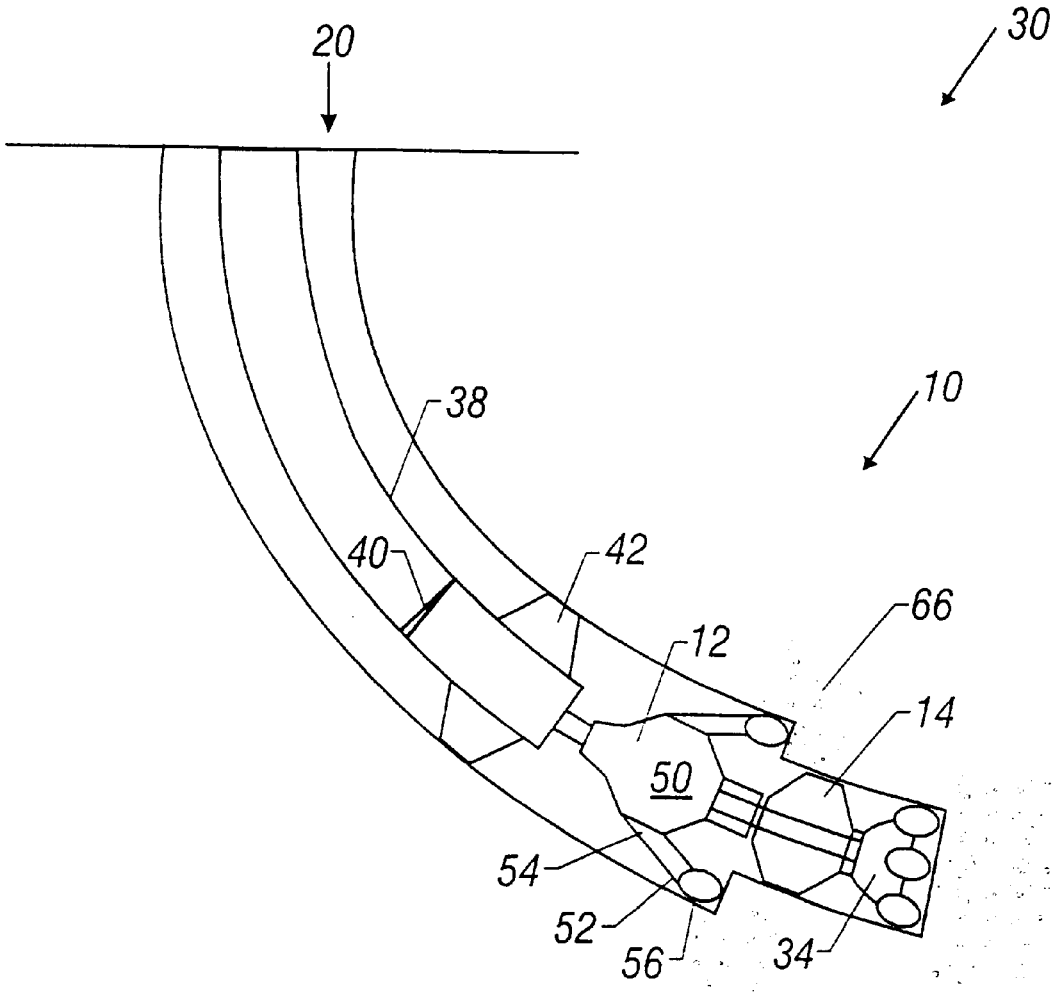
FIG. 2 is a side view of a drilling assembly with the under-reamer assembly of FIG. 1 in the wellbore.
Figure 3:
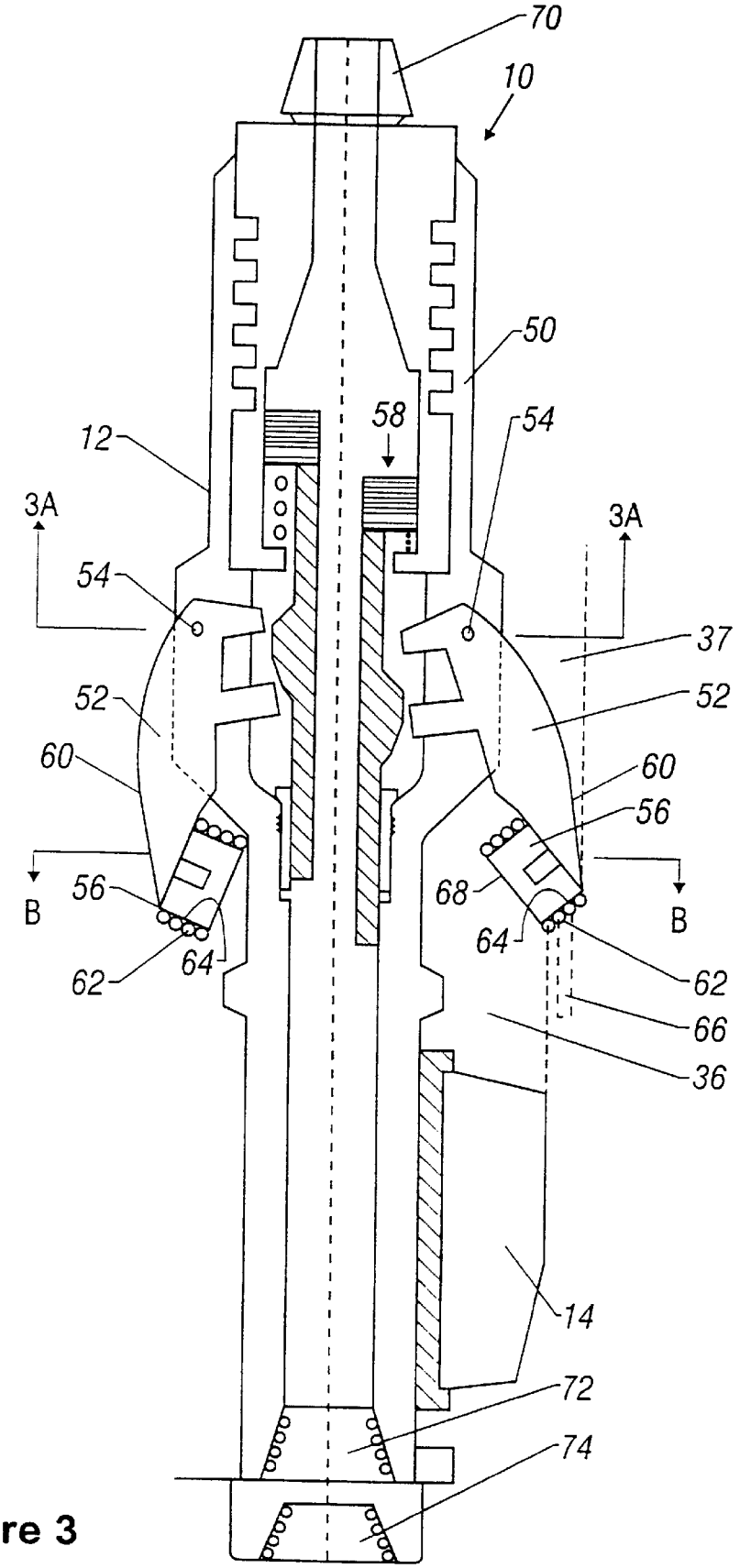
FIG. 3 is a longitudinal-sectional view of the under-reamer assembly of FIG. 1 connected to a pilot bit.
Figure 3A:
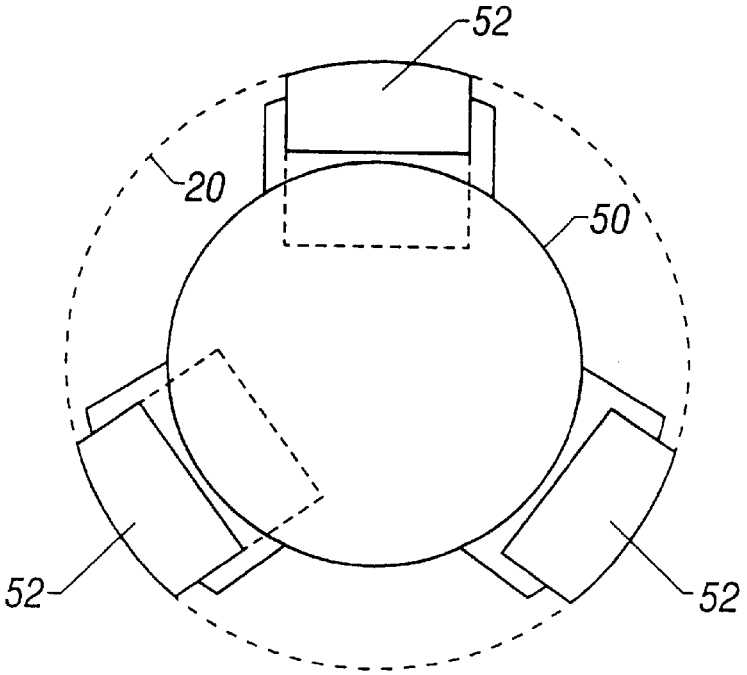
FIG. 3A is a top view of the under-reamer assembly of FIG. 3 along line A—A.
Figure 3B:
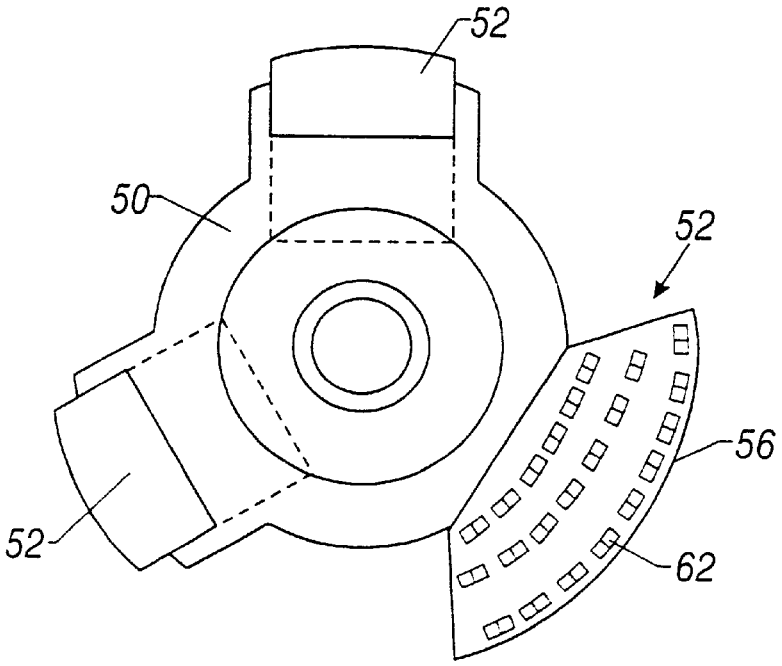
FIG. 3B is a bottom view of the under-reamer assembly of FIG. 3 along line B—B illustrating the cutting element on one of the arms in the cutting position.

In one embodiment of the present invention, an under-reamer assembly 10 for use in downhole ream-while-drilling operations is a directional under-reamer 12 integrated with a non-rotating stabilizer 14. FIG. 1 shows a typical offshore drilling operation utilizing one embodiment of the present invention. FIG. 2 shows the under-reamer assembly 10 incorporated into a drilling string. FIG. 3 is a longitudinal-sectional view of the under-reamer assembly 10. FIG. 3A is a top cross-sectional view of FIG. 3 and FIG. 3B is a bottom cross-sectional view of FIG. 3 illustrating a cutting element 56 at the downhole end of an arm 52.

A typical application for the embodiment of the present invention is in an offshore environment. As shown in FIG. 1, a drilling rig 16 located on an offshore platform 18 is the operations environment for drilling a wellbore 20. The platform 18 is stationed at a predetermined location and is supported by multiple structural supports 22 that extend downward from the platform 18 through the water 24 and into the seabed 26 near the selected production zone 28. Alternate structures for supporting the platform would be familiar to those versed in the art and are not discussed here.

A drilling assembly 30 is used to drill the desired wellbore 20. The drilling assembly 30 is run on drill pipe 32 through the water 24 to the targeted site. A pilot bit 34, located on the downhole end of the drilling assembly 30, drills a pilot hole 36. A motor 38, such as a slick bent housing motor located at the top of the drilling assembly 30 and connected to the drill pipe 32, provides the power to run the pilot bit 34 and the under-reamer 12.

Located between the motor 38 and the pilot bit 34 is the under-reamer assembly 10 which includes the under-reamer 12 and an integrated non-rotating stabilizer 14. To maximize the efficiency of the motor 38, it is important to reduce the torque output from the motor 38. By using a non-rotating stabilizer 14, the torque output of the motor 38 is reduced. Additionally, by locating the non-rotating stabilizer 14 as close as possible to the under-reamer 12 so as to minimize the distance between the cutting elements 56 on the under reamer 12 and the stabilizer 14, side loads on the under-reamer arms 52 are minimized. One embodiment of the present invention minimizes this distance by integrating the non-rotating stabilizer 14 with the under-reamer 12 into the under-reamer assembly 10. The size of the non-rotating stabilizer 14 in this embodiment is approximately one-quarter to one-eighth inch smaller than the gauge of the pilot bit 34.

The downhole end of the motor 38 is connected to a directional device 40, such as a knuckle joint, allows changing the direction of the drilling to the desired angle of inclination. The directional device 40 is sometimes referred to as a "kick-off". The under-reamer assembly 10 is positioned in the drilling assembly 30 at a point below this directional device 40.

FIG. 2 shows a longitudinal-sectional view of a typical drilling assembly 30. The motor 38 is located at the top of the drilling assembly 30. The directional device 40 is activated to provide the desired angle of inclination for the pilot bit 34. The non-rotating stabilizer 14, located above the pilot bit 34, serves two purposes. It provides the proper angled direction for the under-reamer 12 to follow the pilot bit 34 and it provides stabilizing means for the under-reamer 12 and the pilot bit 34. A second stabilizer 42 is shown in this typical operation.

FIG. 3 is a longitudinal-sectional view of the embodiment of the present invention 10 which, as shown in FIG. 2, connects at the downhole end at a lower connector 72 to an upper connector 74 of the pilot bit 34. The under-reamer assembly 10 includes a body 50, multiple elongated arms 52 which are pivotally connected at pivot points 54 to the body 50 and have cutting elements 56 at the downhole ends 60, and the non-rotating stabilizer 14.

The arms 52 are activated to move to their cutting position (FIG. 3) by conventional methods, such as hydraulics 58, which are well known in the field. The arms 52 in the embodiment are tapered at the downhole ends 60 to minimize snagging problems when running the under-reamer 12 downhole.

FIGS. 3A and 3B are cross-sectional top and bottom views, respectively, of FIG. 3 through lines A—A and B—B, respectively. FIG. 3B shows the under-reamer with three arms 52 for illustrative purposes only and are not meant to limit the invention. Other configurations having multiple arms 52 are intended to be within the scope of this invention.

FIG. 3A shows the cutting element 56 on one of the arms 52. The cutting element 56 contains a plurality of cutting members, such as teeth 62. One embodiment, as shown in FIG. 3, only has teeth 62 on the outer edge 64 of the cutting element 56 that will drill through the earth material 66. There are no unused teeth 62 on the inner portion 68.

Figure 4:
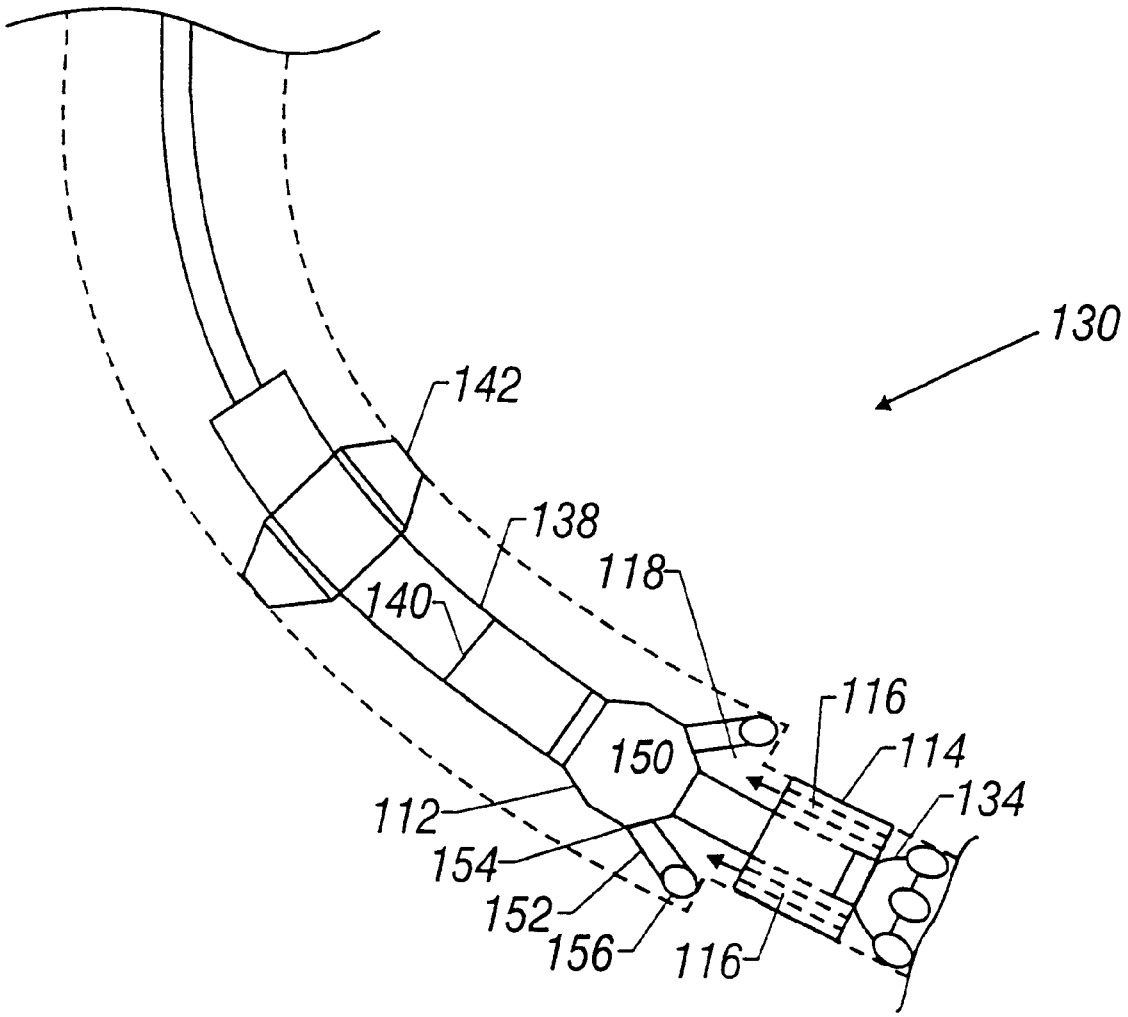
FIG. 4 is a side view of a second embodiment of the drilling assembly.

FIG. 4 shows a perspective view of an alternate drilling assembly 130. The downhole end of the motor 138 is located at the top of the drilling assembly 130. The directional device 140 is activated to provide the desired angle of inclination for the pilot bit 134. The stabilizer 114, located above the pilot bit 134 is fixed relative to the drill bit. Such an arrangement of the stabilizer is easier to manufacture than a non-rotating stabilizer because it is less complex than a non-rotating stabilizer and can be made quite sturdy. There is a tradeoff for this reduced complexity in the increased torque load on the motor. As in the embodiment shown in FIG. 2, it provides the proper angled direction for the under-reamer 112 to follow the pilot bit 134 and it provides lateral stabilization for the under-reamer 112 and the pilot bit 134. A second stabilizer 142 is shown in this typical arrangement located above the directional device 140. The under-reamer assembly 112 includes a body 150 with multiple arms 152 pivotally connected to the body 150. In yet another arrangement, not shown, the second stabilizer is located between the directional device 140 and the body 150 of the under-reamer assembly 112. Also shown in FIG. 4, the stabilizer 114 is provided with passages 116 to allow drilling mud to flow back 118 from the drill bit through the stabilizer 114.

Figure 5:
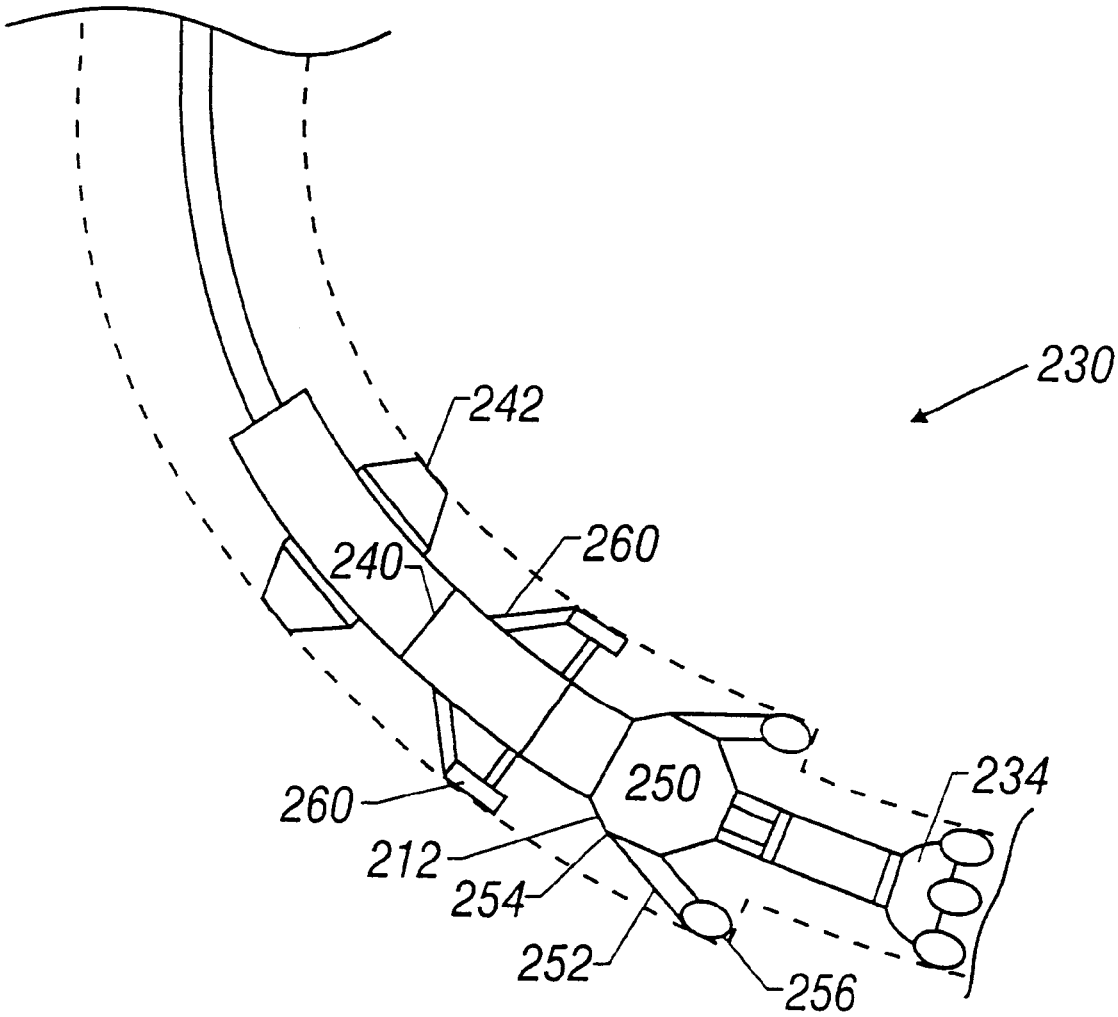
FIG. 5 is a side view of a third embodiment of the drilling assembly.

Another embodiment of the invention incorporates a stabilizer with adjustable arms as part of the drilling assembly. This is shown in FIG. 5 of a drilling assembly 230. The downhole end of the motor 238 is located at the top of the drilling assembly 230. The directional device 240 is activated to provide the desired angle of inclination for the pilot bit 234. The under-reamer assembly 212 includes a body 250 with multiple arms 252 pivotally connected to the body 250. The under-reamer assembly 212 is coupled to the pilot bit 214. A stabilizer 260 is located between the under-reamer assembly 212 and the directional device 240. The stabilizer 260 provides the first point of stability for the under-reamer 212 and the pilot drill bit 214. It is capable of being expanded or contracted to fit the larger size hole being reamed out by the under-reamer assembly. The close contact between the stabilizer 260 and the borehole may be maintained by hydraulic, mechanical or electromechanical devices. Apparatus for maintaining this close contact would be familiar to those versed in the art and is not discussed further here. A second stabilizer may be located above the directional device 140 to provide additional stability to the drilling assembly. In an alternate arrangement, not shown, the second stabilizer may be located between the under-reamer and the drill bit. In yet another arrangement, additional stabilizers are provided as shown at 242 as well was between the under-reamer and the drill bit.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A drilling tool for forming a borehole in an earth formation, comprising:

(a) a drill bit at an end of the drilling tool, said drill bit upon rotation forming a first portion of the borehole having a first size;

(b) a cutting device uphole of the drill bit, said cutting device upon rotation forming a second portion of the borehole which is greater in size than the first portion;

(c) a drilling motor carried by the drilling tool, said drilling motor rotating the drill bit and the cutting device when a fluid under pressure is passed through the drilling motor, thereby forming the first and second portions of the borehole;

(d) a first stabilizer between the drill bit and the cutting device for providing lateral stability and drilling direction guidance to the drill bit; and (e) a second stabilizer uphole of the cutting device, said second stabilizer including at least one member adapted to extend radially from the tool to contact the borehole to provide radial stability to the drilling tool during drilling of the borehole.

2. The drilling tool of claim 1, wherein said first stabilizer is one of (i) a substantially non-rotating stabilizer relative to the rotation of the drill bit and (ii) a rotating stabilizer.

3. The drilling tool of claim 1 further comprising a bend downhole of the drilling motor, said bend defining drilling direction of the borehole.

4. The drilling tool of claim 1 further comprising a kick-off sub in said tool for causing the drill bit and the cutter to drill a deviated borehole.

5. The drilling tool of claim 1, wherein the cutting device includes a plurality of radially movable arms, each said arm having a cutting element at an outer end of such arm to form the second portion of the borehole.

6. The drilling tool of claim 5 wherein each said arm is selectably movable between a retracted position and a cutting position.

7. The drilling tool of claim 6 wherein the arms are hydraulically operated between their respective retracted and cutting positions.

8. The drilling tool of claim 1, wherein the first stabilizer and the cutting device are integrated into a subassembly.

9. The drilling tool of claim 1, wherein the first stabilizer includes at least one fluid passageway for allowing the drilling fluid to pass between the drill bit and the cutting device.

* * * * *